United States Patent [19]

Hopley

[11] 4,402,415

[45] Sep. 6, 1983

[54] INTEGRALLY SEALED CONTAINER WITH CAP

[75] Inventor: Eric T. Hopley, Poringland, England

[73] Assignee: U. G. Closures & Plastics Limited, Middlesex, England

[21] Appl. No.: 312,072

[22] Filed: Oct. 16, 1981

[30] Foreign Application Priority Data

Oct. 17, 1980 [GB] United Kingdom ..... 8033670
Sep. 16, 1981 [GB] United Kingdom ..... 8127969

[51] Int. Cl.[3] ..... B65D 1/02
[52] U.S. Cl. ..... 215/32; 215/256
[58] Field of Search ..... 215/32, 256, 252

[56] References Cited

U.S. PATENT DOCUMENTS 3,650,428 3/1972 Miller ..... 215/252
3,837,518 9/1974 Gach ..... 215/256 X
4,176,755 12/1979 Winchell ..... 215/32

FOREIGN PATENT DOCUMENTS 1526780 4/1968 France ..... 215/256

*Primary Examiner*—Donald F. Norton

*Attorney, Agent, or Firm*—Cushman, Darby & Cushman

[57] ABSTRACT

A sterile pack comprising, in combination, a moulded plastics container (1) to which is attached a moulded plastics cap (20), the container being integrally sealed at its upper end, the neck of the container being provided with thread (3), an annular portion (10) of the neck above the thread being frangible, and the cap having a thread complementary with the container thread and means for contacting the container above the said annular portion, is characterized in that the thread (3) has a pitch of between 0.05 and 0.095 turns per millimeter per millimeter of thread diameter, and that the diameter of the frangible portion (10) of the container is at most 80% of the thread diameter.

The container is opened by screwing the cap further onto the container, so that the container-contacting part of the cap above the frangible portion causes relative movement between the top of the container and the remainder thereof, thus breaking the frangible portion of the container, and then unscrewing the cap, in the normal way, to remove the sheared-off upper part of the container from the rest of the container, and expose the contents of the container.

9 Claims, 9 Drawing Figures

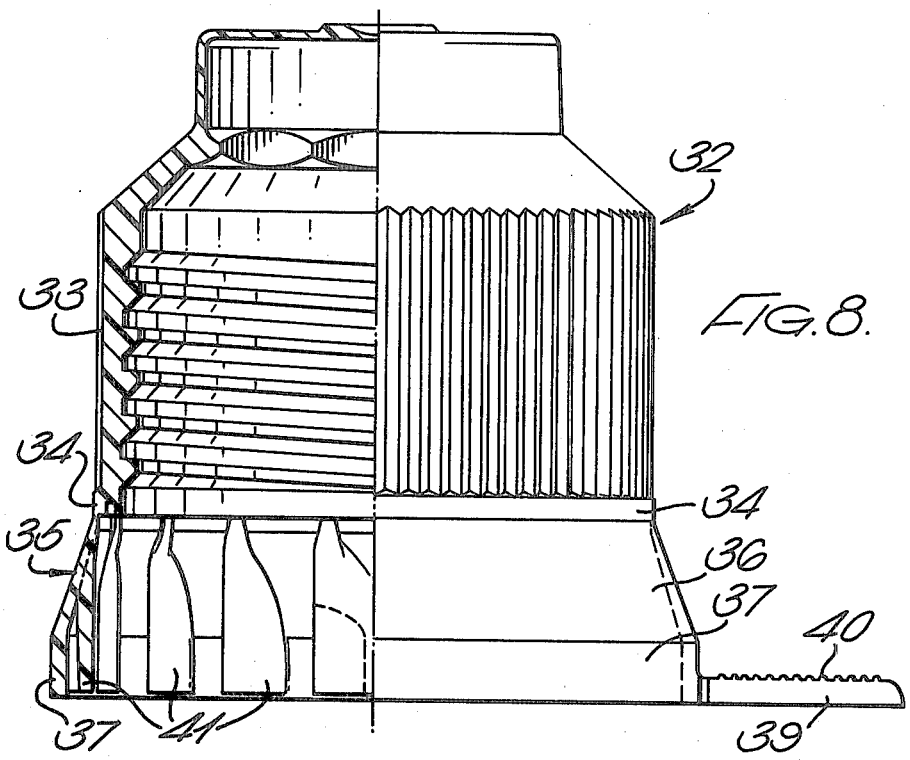
FIG. 8.
FIG. 9.
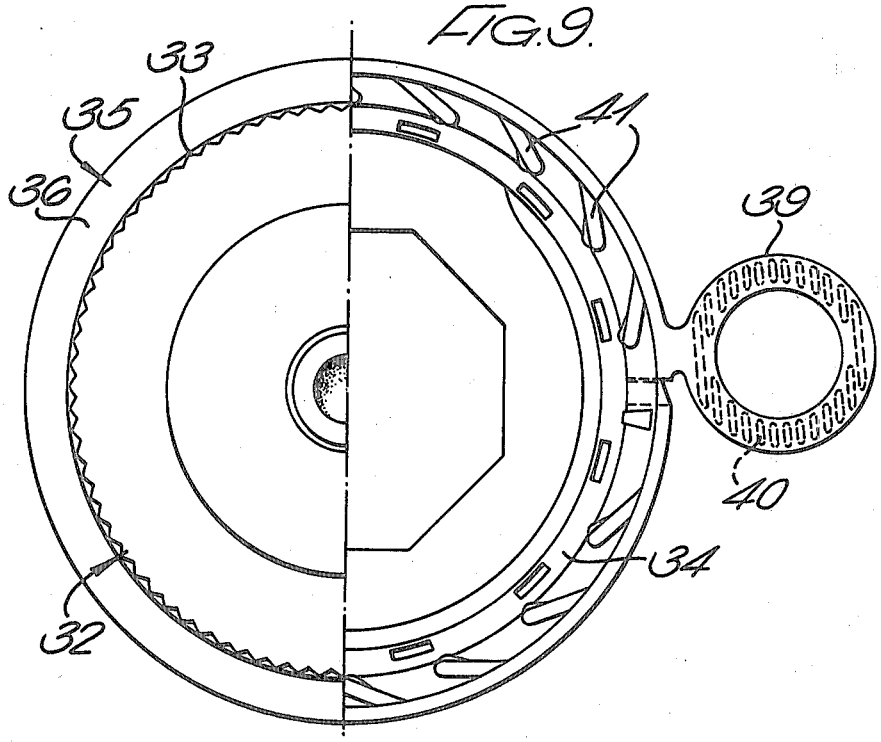

INTEGRALLY SEALED CONTAINER WITH CAP

This invention relates to closures, and especially to the combination of a closure with a container which is used for the packaging of sterile fluids, e.g. sterile water.

Such sterile packs, being the combination of a sterile fluid-containing container having an integral seal at its upper end, and a closure, are known. The container is manufactured, filled with sterile liquid and sealed in a single operation, after which the closure is applied. The neck of the container and the closure are so constructed that an initial movement of the closure, before it is removed from the container, breaks the seal on the container.

In one known method for the production of sterile packs, the container is blow-moulded from a plastics material, for example polypropylene. Sterile fluid, e.g. sterile water, is admitted into the container during the moulding stage and the contents of the container sealed by the formation of an integral seal, normally in the shape of a domed portion, at the upper end of the container. On leaving the mould, the container is therefore formed, filled and sealed. Further heat sterilisation can be achieved by autoclaving, following which a closure is applied to the neck of the container.

In a known form of pack, the neck of the container is formed with a frangible diaphragm, which is broken by an initial downward movement of the closure, whereafter the closure may be removed in the normal way and the contents of the container exposed. Inadvertent downward movement of the closure is prevented by means of a pilfer-proof band which must be removed before movement of the closure can be effected.

In practice it has been found that the known packs are not completely reliable. The major disadvantage has been that the frangible membrane has not sheared esaily, and has accordingly remained attached to the containers when the closure is removed.

It is the object of the present invention to provide a sterile pack which does not suffer from this disadvantage.

According to the present invention a sterile pack comprises, in combination, a moulded plastics container to which is attached a moulded plastics cap, (i) the container being integrally sealed at its upper end, the neck of the container being provided with thread and an annular portion of the neck above the thread being frangible, (ii) the cap having a thread complementary with the container thread and means for contacting the container above the said annular portion, characterised in that the thread has a pitch of between 0.05 and 0.095 turns per millimeter per millimeter of thread diameter, and that the diameter of the frangible portion of the container is at most 80% of the thread diameter.

In accordance with one embodiment of the invention, the thread has a pitch of at least 0.08 turns per millimeter per millimeter of thread diameter and the diameter of the frangible portion of the container is at most 75% of the thread diameter.

In order to open the container, the cap will firstly be screwed further onto the container, so that the container-contacting part of the cap above the frangible portion causes relative movement between the top of the container and the remainder thereof, thus breaking the frangible portion of the container. Unscrewing of the cap thereafter removes the sheared-off upper part of the container from the rest of the container, thus exposing the contents of the container. The combination of the fine pitch thread and the diameter of the frangible portion guarantees ready and complete shearing of the frangible portion, and thus opening of the container.

Suitably, inadvertent shearing of the frangible portion is prevented by means of a pilfer-proof ring provided at the lower end of the cap skirt and engaging a complementarily-shaped part on the container. Removal of the pilfer-proof ring must be completed before the cap can be moved downwardly on the container to shear the frangible portion thereof.

Preferably the container is moulded with an outwardly-directed annular shoulder beneath the thread on the neck of the container, which shoulder is tightly engaged by the lowermost end of the skirt of the cap or the pilfer-proof ring, when the cap is attached to the container in sealing position. This tight engagement between the cap skirt or pilfer-proof ring and the shoulder formed on the container forms a secondary seal which prevents foreign matter getting between the cap skirt and the neck of the container.

The pilfer-proof ring may be formed internally with a series of teeth or ratchets which mesh with corresponding teeth or ratchets formed on the container neck, thus rendering removal of the cap impossible until such time as the pilfer-proof ring has itself been removed, e.g. by tearing, from the cap skirt. Preferably, however, a detachable ring forming the lowermost portion of the cap skirt is provided interiorly with a series of flexible fins which engage with lugs, teeth or other ramp-like formations on the neck of the container, below the thread. Such fin/lug configuration prevents unscrewing removal of the cap from the container until such time as the detachable ring portion of the cap skirt has been removed, in the same way as does the teeth/ratchet formation mentioned above, but has the advantage over the latter that it makes the application of the cap to the container somewhat easier (i.e. less torque is required) and does not suffer the disadvantage that can occur with the more rigid teeth/ratchets which tend, on application of the cap to the container, to wear the contacting parts of each other away. Furthermore, the flexible fin configuration results in there being less stress in the skirt of the cap above the pilfer-proof ring, and thus less likelihood of inadvertent splitting of the pilfer-proof ring between the tear tab by which is it removed and the line of weakening separating it from the rest of the cap skirt.

Reference will now be made to the accompanying drawings, in which:

FIG. 8 is a side view of the cap of FIG. 7, partly in section; and

FIG. 9 is both a top (left-hand side) and an underneath (right-hand side) plan view of the cap of FIGS. 7 and 8.

Figure 1:
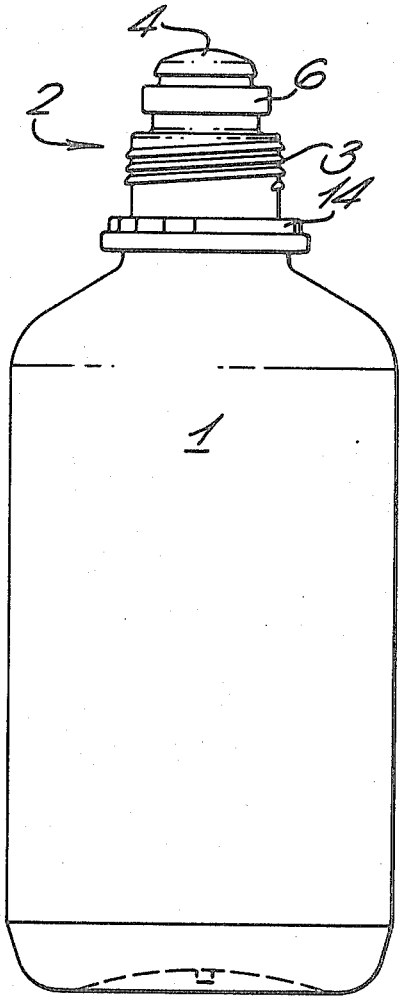
FIG. 1 is a side view of a sealed container, before application of a cap thereto.
Figure 2:
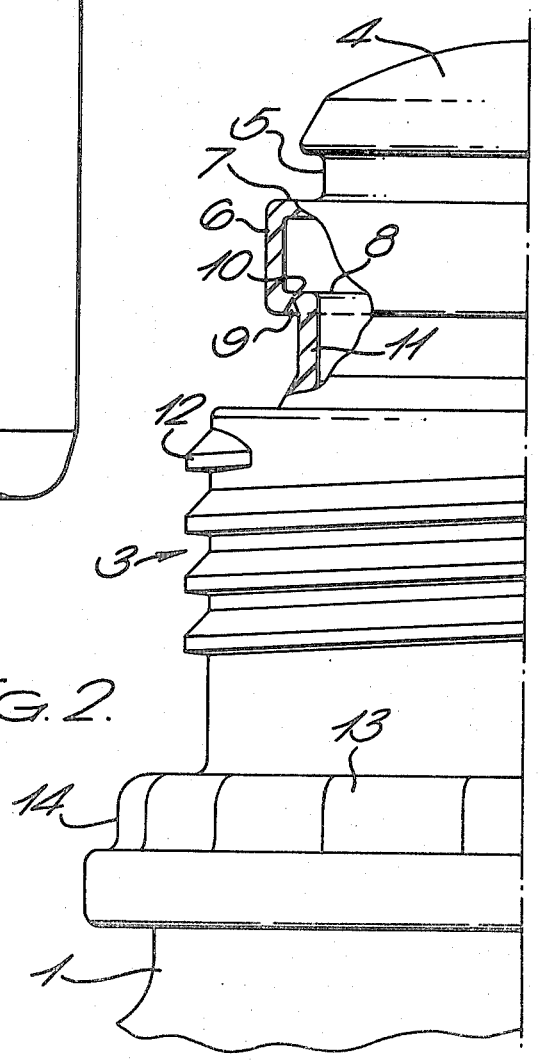
FIG. 2 is a detailed view, partly in section, of the top of the neck portion of the container of FIG. 1.
Figure 4:
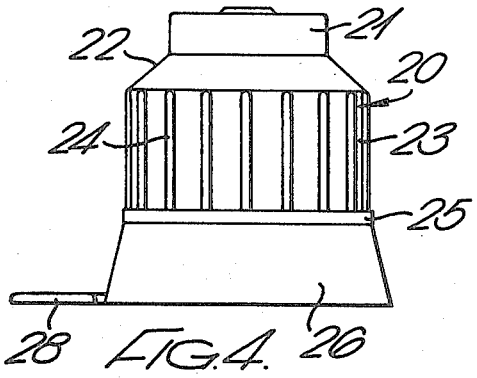
FIGS. 4, 5 and 6 are, respectively, side, underneath and sectional views of the cap shown in FIG. 3.
Figure 5:
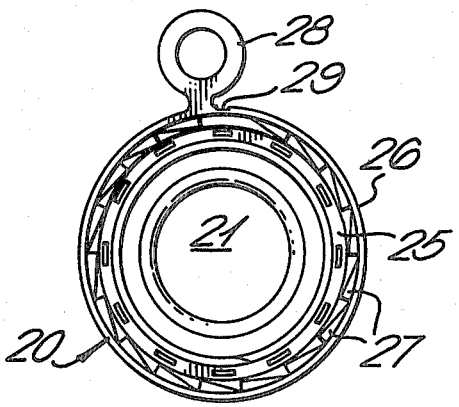
Figure 6:
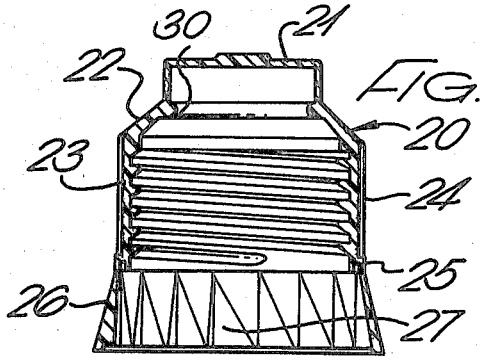

Referring now to FIGS. 1 and 2, a container 1 is formed of a plastics material, e.g. polypropylene, in a machine which, during the moulding operation, fills the container with a sterile liquid, e.g. sterile water, and forms an upper part 2 comprising a screw-threaded part 3 and an integrally-formed dome-shaped seal 4.

An inwardly-directed shoulder 5 below the domed portion 4 connects with a ring portion 6 through a horizontal shoulder 7. At the bottom of ring portion 6 is a shoulder 8, parallel to shoulder 7, having an inverted V-shaped channel 9 forming an annular portion 10 of substantially reduced thickness in comparison with the remainder of the neck portion of the container. A tubular portion 11 merges into a threaded portion 12, below which is a series of teeth 13 arranged in an annular band 14 around the container neck. The diameter of the annular frangible portion 10 is at most 80% of the outside diameter of the thread 12. The thread has a pitch of 0.05 to 0.095, preferably at least 0.08, turns per millimeter per millimeter of thread diameter. For example, if the outside diameter of the thread is 37.3 mm. the pitch of the thread may be 3.3 turns per millimeter, and the diameter of the annular frangible portion 10 may be 25 mm.

The sterile pack is completed by a cap 20 (see FIGS. 3 to 6) having a top 21 attached through a frustoconical portion 22 to an internally-screw-threaded skirt 23. The skirt 23 is provided exteriorly with coarse knurling 24 and frangibly attached to its lower end, through a weakened portion 25, is a pilfer-proof band 26.

The pilfer-proof band 26 is provided internally with a series of ratchets 27 which engage with the teeth 13 on the container in the manner described and illustrated in U.K. Pat. Specification No. 1,473,257. A tear-ring 28 is integrally moulded with the band 26, which may be removed by pulling the tear-ring 28 initially to fracture a weakened portion 29 and then to break the annular weakening line 25.

The cap is formed internally with an annular inwardly-directed bead 30 which is of such a size as to be snapped over the outer extremity of the dome seal 4 in order to contact the upper shoulder 7 of the ring portion 6 of the container neck.

Figure 3:
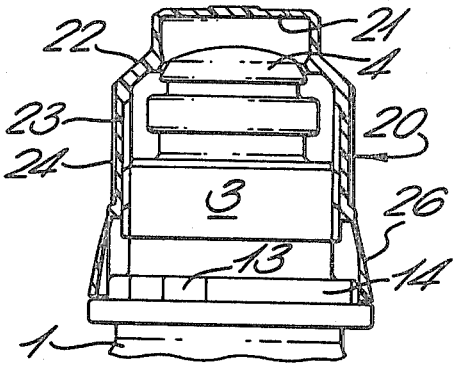
FIG. 3 is a view, partly in section, of a cap applied to the container of FIG. 1.

FIG. 3 shows the top of the sterile pack in its normal sealed and closed configuration. The pack is opened by the following sequence of steps:

(a) the tear-ring 28 is grasped and pulled to remove the pilfer-proof band 26 from the skirt 23 of the cap;

(b) the cap is screwed further onto the neck of the container, bead 30 passing over dome 4, contacting shoulder 7 and pushing ring portion 6 downwardly;

(c) continued on-screwing of the cap breaks the annular frangible portion 10, thus breaking the container seal;

(d) the cap is then unscrewed, and by virtue of the bead 30 having passed over the dome 4 into the shoulder 5, the portion of the container comprising the dome 4, shoulder 5 and ring portion 6 are removed together with the cap.

Figure 7:
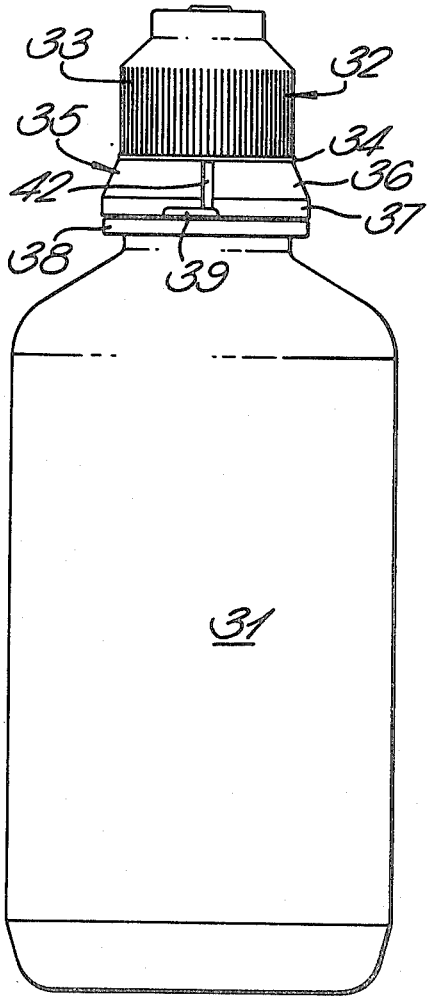
FIG. 7 shows a second embodiment of a pack comprising a moulded plastics container and a moulded plastics cap, just before the cap is screwed tightly onto the container.

Referring now to FIGS. 7 to 9 of the drawings, FIG. 7 shows a container 31 of substantially identical form to that shown in FIG. 1. The top of the container (not shown) is sealed in the mould-fill-seal machine and a cap 32 is screw-threaded thereon. The cap 32 comprises an externally-knurled cylindrical portion 33 attached through a frangible portion 34 of lesser thickness to a lower skirt 35 comprising an upper frusto-conical portion 36 merging into a lower cylindrical portion 37 which, when the cap is screwed fully home on the container neck, seats tightly on an annular shoulder 38 integrally moulded on the container 31. As shown in FIG. 7, the cap 32 has not quite reached its fully screwed-on position. The portion 37 of the cap is provided with an outwardly-directed tear-tab 39, provided with raised ribs 40 to assist manual grasping. A line of weakening 42, constituted by a portion of thinner section, extends axially between the tear-tab 39 and the frangible portion 34.

Internally of the skirt portion 35 is formed a series of inwardly-directed flexible fins 41, each forming an angle with a radius of the cap between 70° and 85°. Fins 41 cooperate with spaced lugs or ratchet teeth formed on the container neck above the shoulder 38, for example of the type designated 13 in FIG. 2.

The cap 32 is applied to and removed from the container 31 in the same way as is described in relation to the embodiment of FIGS. 1 to 6.

When moulding the upper portion of the container, i.e. that part designated 2 in FIG. 1 of the drawings, it is preferred to form that part of the container above the screw thread without flash, or with as little flash as possible. This assists in achieving a consistent thickness of the frangible portion of the container neck, which assists in the rupture thereof, as described above.

I claim:

1. A sterile pack comprising, in combination, a moulded plastics container to which is attached a moulded plastics cap, (i) the container being integrally sealed at its upper end, the neck of the container being provided with thread and an annular portion of the neck above the thread being frangible, (ii) the cap having a skirt provided with a pilferproof ring which prevents removal of the cap from the container until the pilferproof ring is removed from the cap along a line of weakness joining said ring to said cap skirt, the cap also having a thread complementary with the container thread and means for contacting the container above the said annular portion, characterised in that the thread has a pitch of between 0.05 and 0.095 turns per millimeter per millimeter of thread diameter, and that the diameter of the frangible portion of the container is at most 80% of the thread diameter.

2. A pack as claimed in claim 1 wherein the thread has a pitch of at least 0.08 turns per millimeter per millimeter of thread diameter and the diameter of the frangible portion of the container is at most 75% of the thread diameter.

3. A pack as claimed in claim 1 wherein the inside surface of the pilferproof ring is shaped complementarily to the opposing surface of the container neck, to present abutting surfaces of the ring and container neck and prevent unscrewing of the cap from the container.

4. A pack as claimed in claim 3 wherein said abutting surfaces comprise lugs formed on the pilferproof ring and on the container neck.

5. A pack as claimed in claim 3 wherein said abutting surfaces comprise flexible fins on the pilferproof ring and fin-engaging projections on the container neck.

6. A pack as claimed in claim 5 wherein the flexible fins each form an angle of between 70° and 85° with a radius of the cap.

7. A pack as claimed in claim 1 wherein the lower edge of the pilferproof ring abuts an annular shoulder on the container neck.

8. A pack as claimed in claim 1 wherein the pilferproof ring is provided with a tear tab, an axial line of weakness being formed between the junction of said tear tab with said ring and the line of weakness joining said ring to said cap skirt.

9. A sterile pack comprising, in combination, a moulded plastics container to which is attached a moulded plastics cap, (i) the container being integrally sealed at its upper end, the neck of the container being provided with thread and an annular portion of the neck above the thread being frangible, (ii) the cap having a skirt provided with a pilferproof ring which prevents removal of the cap from the container until the pilferproof ring is removed from the cap along a line of weakness joining said ring to said cap skirt, the cap also having a thread complementary with the container thread and means for contacting the container above the said annular portion, characterised in that the diameter of the frangible portion of the container is at most 80% of the thread diameter.

* * * * *